US009394078B1

(12) United States Patent
Roberts

(10) Patent No.: US 9,394,078 B1
(45) Date of Patent: Jul. 19, 2016

(54) PALLET ASSEMBLY

(71) Applicant: Oddello Industries, LLC, Morristown, TN (US)

(72) Inventor: Thomas A. Roberts, Dandridge, TN (US)

(73) Assignee: Oddello Industries, LLC, Morristown, TN (US)

( * ) Notice: Subject to any disclaimer, the term of this patent is extended or adjusted under 35 U.S.C. 154(b) by 0 days.

(21) Appl. No.: 14/874,082

(22) Filed: Oct. 2, 2015

(51) Int. Cl.
*B65D 19/00* (2006.01)
*B65D 19/06* (2006.01)

(52) U.S. Cl.
CPC ..... *B65D 19/06* (2013.01); *B65D 2519/00019* (2013.01); *B65D 2519/00034* (2013.01); *B65D 2519/00273* (2013.01); *B65D 2519/00432* (2013.01)

(58) Field of Classification Search
CPC ..... B65D 19/06; B65D 2519/00019; B65D 2519/00034; B65D 2519/00273; B65D 2519/00432; B65D 2519/00054; B65D 2519/00089; B65D 2519/00124; B65D 2519/00159
USPC ..... 108/51.3, 51.11, 56.1
See application file for complete search history.

(56) References Cited

U.S. PATENT DOCUMENTS 2,643,080 A * 6/1953 Vogel ..... B65D 19/0085 108/51.3
2,928,578 A * 3/1960 O'C Parker ..... B65D 19/0016 108/51.3
3,026,015 A * 3/1962 Severn ..... B65D 19/20 108/51.3
4,759,295 A * 7/1988 Nilsen ..... B65D 19/0016 108/51.3
5,121,696 A * 6/1992 Harder ..... B65D 19/0026 108/51.3
5,285,731 A * 2/1994 McIntyre ..... B65D 19/0026 108/51.3
5,337,679 A * 8/1994 Moorman ..... B65D 19/0026 108/51.3
5,383,409 A * 1/1995 Hayakawa ..... B65D 19/0016 108/51.3
6,029,582 A * 2/2000 Ogilvie, Jr. ..... B65D 19/0012 108/165
2005/0098067 A1* 5/2005 Sketo ..... B65D 19/0012 108/51.3
2006/0225626 A1* 10/2006 Olvey ..... B65D 19/0002 108/51.3
2008/0295747 A1* 12/2008 Vinderola ..... B65D 19/0028 108/51.3
2011/0303128 A1* 12/2011 Linares ..... B65D 19/0012 108/51.3
2012/0322642 A1* 12/2012 Lu ..... B65D 19/0095 493/405
2015/0197368 A1* 7/2015 Casey ..... B65D 19/38 108/51.3
2015/0239609 A1* 8/2015 Olvey ..... B65D 19/0012 108/51.3

* cited by examiner

*Primary Examiner* — Jose V Chen
(74) *Attorney, Agent, or Firm* — Shaddock Law Group, PC

(57) ABSTRACT

A pallet assembly having a pallet element extending from a top deck panel portion to opposing end panels and side panels, wherein a panel rail member is at least partially folded within each side panel to form opposing pallet sidewalls, and wherein each end panel is at least partially folded to form opposing pallet and walls; two or more notch apertures formed through portions of the side panels; an insert element, wherein the insert element is positioned below at least a portion of the top deck panel portion; and two or more insert element apertures formed through portions of the insert element, wherein each insert element aperture is aligned with a rail notch formed in the insert element rail member to form insert element notches.

20 Claims, 13 Drawing Sheets

PALLET ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of pallets. More specifically, the presently disclosed systems, methods, and/or apparatuses relates to a pallet assembly adaptable to be used with a firearm.

2. Description of Related Art

It is generally known to use pallets as a portable platform for handling, storing, or moving materials and packages in warehouses, factories, or vehicles. Generally, pallets are constructed of comparatively soft wood and typically consist of three or four stringers that support several panels or deck boards.

Items are typically placed atop the deck boards and the loaded pallets can be moved by forklifts or by mechanical or hand-drawn pallet jacks.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the typical pallet assembly arrangement has various shortcomings. Among other things, the pallet assembly process is somewhat cumbersome and requires a number of components to be fitted together. This makes it difficult for users to maintain a supply of pallet components and construct pallets as needed. Thus, users typically purchase relatively large supplies of pallets, which then need to be stored, awaiting use. Unfortunately, typical pallets can be relatively bulky and cumbersome to store.

Additionally, because of the comparatively soft wood used to form the deck boards, individual deck boards can easily be broken. Once a deck board is broken, the entire pallet must typically be discarded. Thus, while pallets are designed to be reusable, they can be easily damaged and unusable. Furthermore, when a deck board is broken, it can fracture in such a way as to create sharp points that can be harmful to the people handling the pallets or can damage goods.

In various exemplary, non-limiting embodiments, the pallet assembly of the presently disclosed systems, methods, and/or apparatuses comprises a pallet element extending from a top deck panel portion to opposing end panels and side panels, wherein a rail member is at least partially folded within each side panel of the pallet to form a pallet side wall, and wherein each end panel is at least partially folded to form a pallet end wall; an insert element, wherein a rail member is at least partially folded within the insert element to form an insert element, wherein the insert element is positioned below at least a portion of the top deck panel portion, wherein the insert element is positioned between the pallet side walls, and wherein at least a portion of the insert element is positioned below at least a portion of each rail member at least partially folded within each side panel; and entry opening cutouts defining entry opening flaps of each end panel, wherein the entry opening flaps are folded to form entry openings in the pallet end walls.

In various other exemplary, non-limiting embodiments, the pallet assembly comprises a pallet element extending from a top deck panel portion to opposing end panels and side panels, wherein a panel rail member is at least partially folded within each side panel to form opposing pallet sidewalls, and wherein each end panel is at least partially folded to form opposing pallet and walls; two or more notch apertures formed through portions of the side panels, wherein each entry notch aperture is aligned with a rail notch formed in each of the panel rail members to form an entry notch where each entry notch aperture is aligned with a rail notch of the panel rail members; an insert element, wherein an insert element rail member is at least partially folded within the insert element, wherein the insert element is positioned below at least a portion of the top deck panel portion, wherein the insert element is positioned between the pallet side walls, and wherein at least a portion of the insert element is positioned below at least a portion of each panel rail member at least partially folded within each side panel; and two or more insert element apertures formed through portions of the insert element, wherein each insert element aperture is aligned with a rail notch formed in the insert element rail member to form an insert element notch where each insert element aperture is aligned with a rail notch in the insert element rail member.

Accordingly, the presently disclosed systems, methods, and/or apparatuses provides a pallet assembly that can be easily stored in a flat or substantially flat configuration, awaiting final assembly and use.

The presently disclosed systems, methods, and/or apparatuses separately provide a pallet assembly that can be easily constructed, as needed.

The presently disclosed systems, methods, and/or apparatuses separately provide a pallet assembly that provides lower costs for handling and storage.

The presently disclosed systems, methods, and/or apparatuses separately provide a pallet assembly that is reusable.

The presently disclosed systems, methods, and/or apparatuses separately provide a pallet assembly that provides a smooth, level surface upon which to place a load.

The presently disclosed systems, methods, and/or apparatuses separately provide a pallet assembly that provides a continuous upper surface that is separated from any stringers or ribs used to add rigidity or support to the pallet assembly.

The presently disclosed systems, methods, and/or apparatuses separately provide a pallet assembly, which can still be functional, even if one or more pallet assembly components are broken.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein.

Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein. However, it is to be understood that the disclosed embodiments are merely exemplary of the presently disclosed systems, methods, and/or apparatuses that may be embodied in various and alternative forms, within the scope of the presently disclosed systems, methods, and/or apparatuses. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE INVENTION

Figure 1:
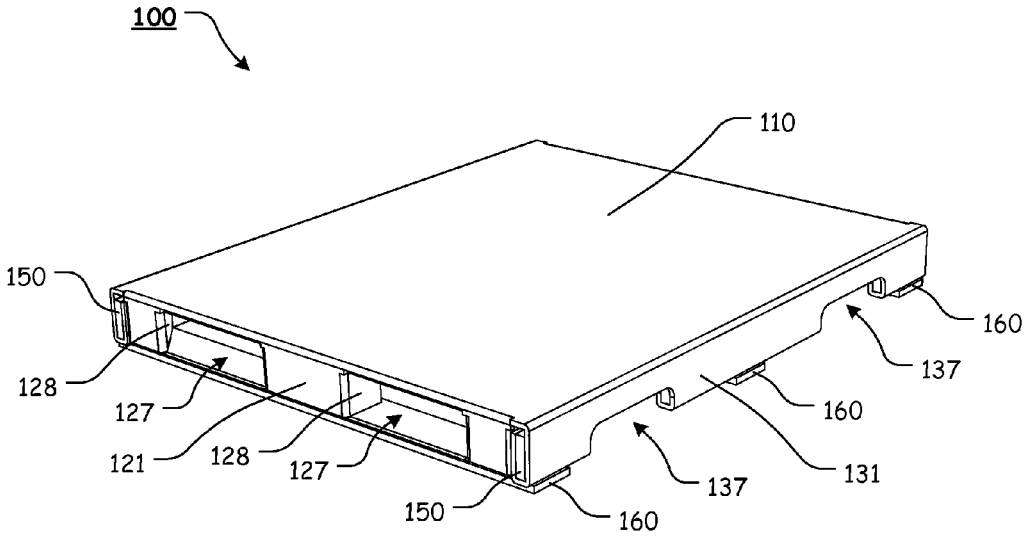
FIG. 1 illustrates a perspective view of an exemplary embodiment of a pallet assembly, according to the presently disclosed systems, methods, and/or apparatuses.

For simplicity and clarification, the design factors and operating principles of the present pallet assembly are explained with reference to various exemplary embodiments of a pallet assembly according to the presently disclosed systems, methods, and/or apparatuses. The basic explanation of the design factors and operating principles of the pallet assembly is applicable for the understanding, design, and operation of the pallet assembly of the presently disclosed systems, methods, and/or apparatuses. It should be appreciated that the pallet assembly can be adapted to many applications where a pallet can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "pallet", "pallet assembly", "pallet element", "insert element", and "insert element" are used for basic explanation and understanding of the operation of the systems, methods, and apparatuses of the presently disclosed systems, methods, and/or apparatuses. Therefore, the terms "pallet", "pallet assembly", "pallet element", "insert element", and "insert element" are not to be construed as limiting the systems, methods, and apparatuses of the presently disclosed systems, methods, and/or apparatuses.

Turning now to the appended drawing figures, FIGS. 1-24 illustrate certain elements and/or aspects of an exemplary embodiment of the pallet assembly, according to the presently disclosed systems, methods, and/or apparatuses. In illustrative, non-limiting embodiment(s) of the presently disclosed systems, methods, and/or apparatuses, as illustrated in FIGS. 1-24, the pallet assembly 100 comprises a pallet element 105, an insert element 140, and rail members 150. It should be understood that FIGS. 2-22, primarily illustrate the elements of the pallet assembly 100 from a bottom view as the bottom view presents a better view of the features and elements of the pallet assembly 100.

Figure 2:
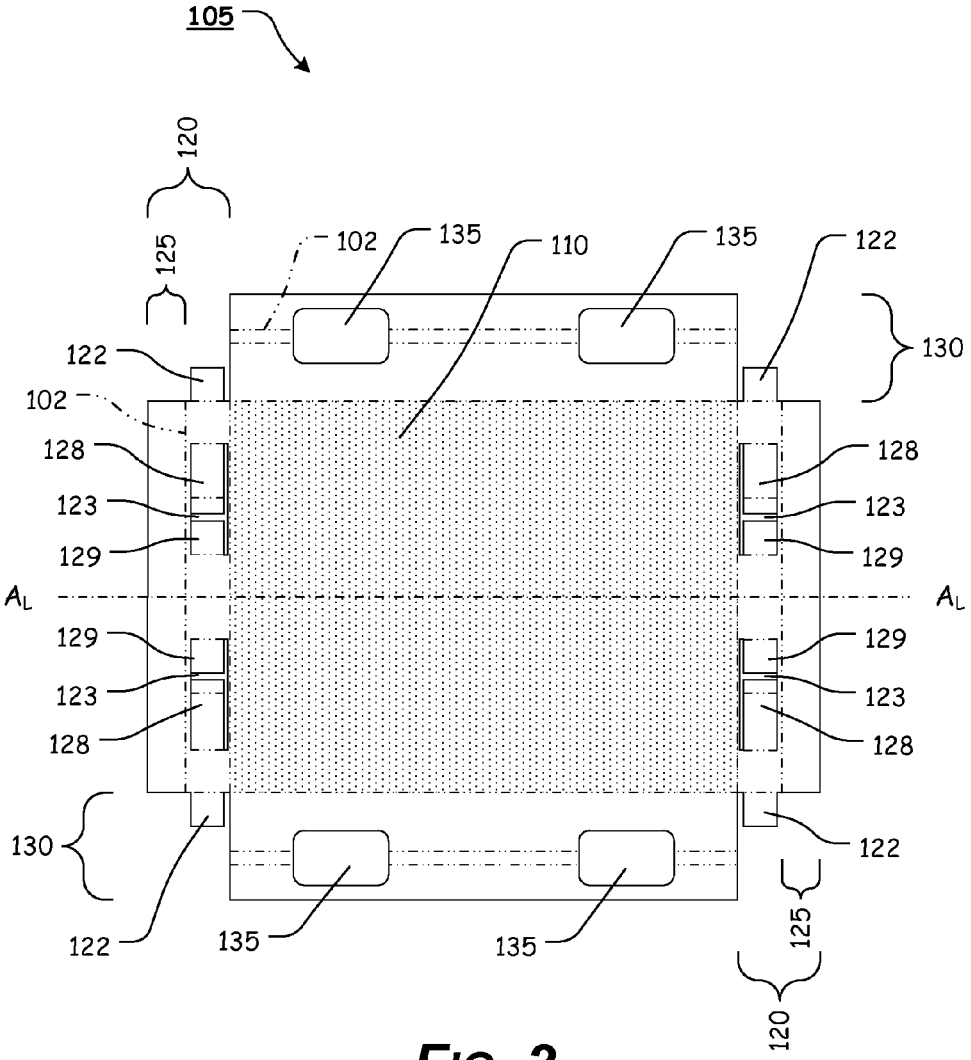
FIG. 2 illustrates a top view of an exemplary embodiment of a pallet element, according to the presently disclosed systems, methods, and/or apparatuses.
Figure 3:
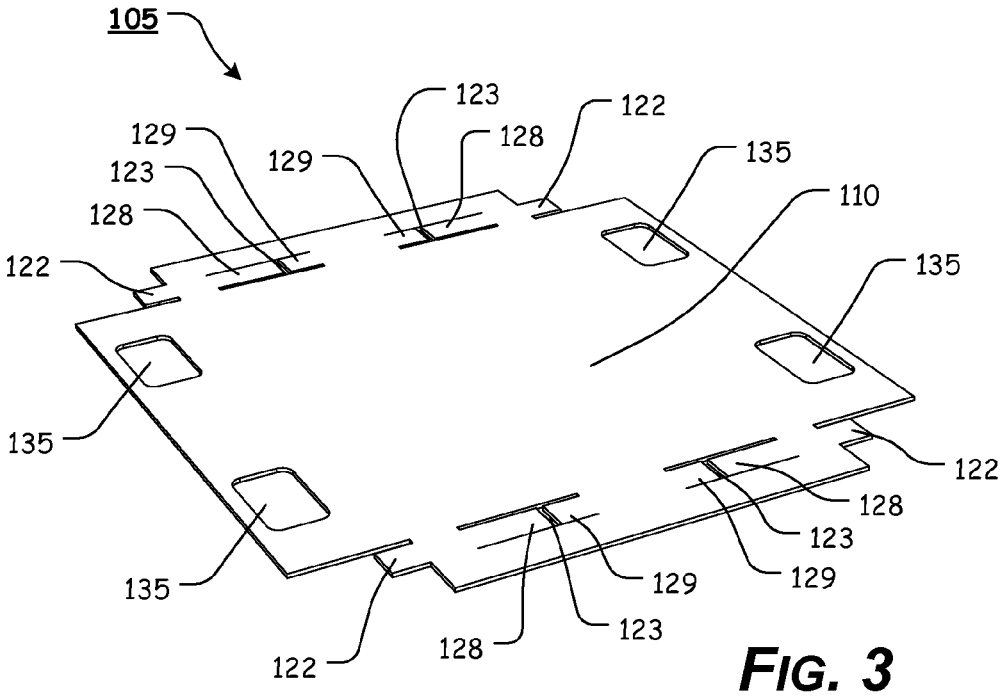
FIG. 3 illustrates a top, side perspective view of an exemplary embodiment of a pallet element, according to the presently disclosed systems, methods, and/or apparatuses.
Figure 4:
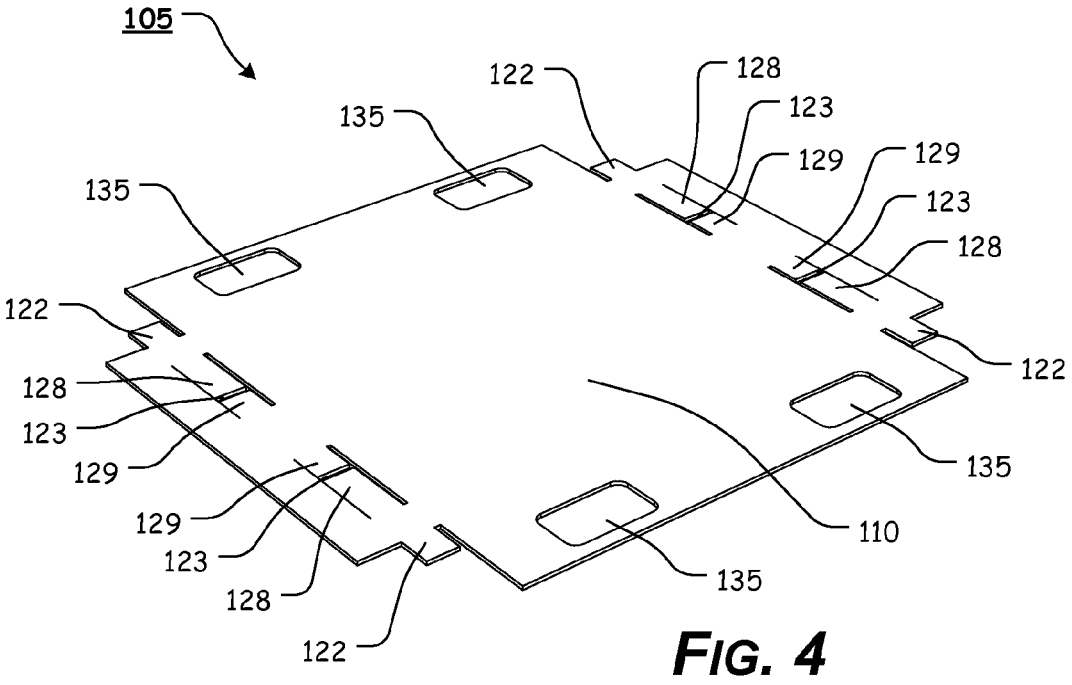
FIG. 4 illustrates a top, end perspective view of an exemplary embodiment of a pallet element, according to the presently disclosed systems, methods, and/or apparatuses.

As illustrated most clearly in FIGS. 2-4, the pallet element 105 is initially presented as a substantially planar, flat portion of material that extends from a top deck panel portion 110 to opposing end panels 120 and side panels 130. By initially being presented in a planar, flat form, numerous panel elements 105 may easily be transported and/or stored.

Various portions or areas of the panel element 105, including, for example, the end panels 120 and side panels 130, are defined by panel element fold lines 102, as shown in dash double-dot lines. The end panels 120 each extend from opposing sides of the top deck panel portion 110. In various exemplary, nonlimiting embodiments, the end panels 120 extend substantially perpendicular to the longitudinal axis AL of the panel element 105, while the side panels 130 extends substantially parallel to the longitudinal axis AL of the panel element 105.

End panel side flaps 122 optionally extend, like tabs, from the end panels 120.

Entry opening cutouts 123 are formed through portions of the end panels 120. In certain exemplary embodiments, each entry opening cutout 123 is formed of a substantially "H" shaped cut or slot through the end panels 120. Each entry opening cutout 123 defines a first entry opening flap 128 and an optional second entry opening flap 129. In certain exemplary embodiments, two entry opening cutouts 123 are formed in each end panel 120.

When the first entry opening flaps 128 and the second entry opening flaps 109 are folded (along the illustrated fold lines), as discussed herein, entry openings 127 are formed through the end panels 120. The entry opening cutouts 123 in each end panel 120 are formed so that opposing entry openings 127 form substantially continuous openings along the length of the pallet assembly 100, substantially parallel to the longitudinal axis AL of the panel element 105.

Entry notch apertures 135 are formed through portions of the side panels 130. In certain exemplary embodiments, each entry notch aperture 135 is formed such that, when folded along appropriate fold lines, as illustrated most clearly in FIGS. 11-13, the entry notch apertures 135 correspond to rail notches 155 formed in the rail members 150 and form entry notches 137.

The entry notch apertures 135 in each side panel 130 are formed so that opposing entry notch apertures 135 form a substantially continuous entry notch 137 along the length of the pallet assembly 100, substantially perpendicular to the longitudinal axis AL of the panel element 105.

Figure 5:
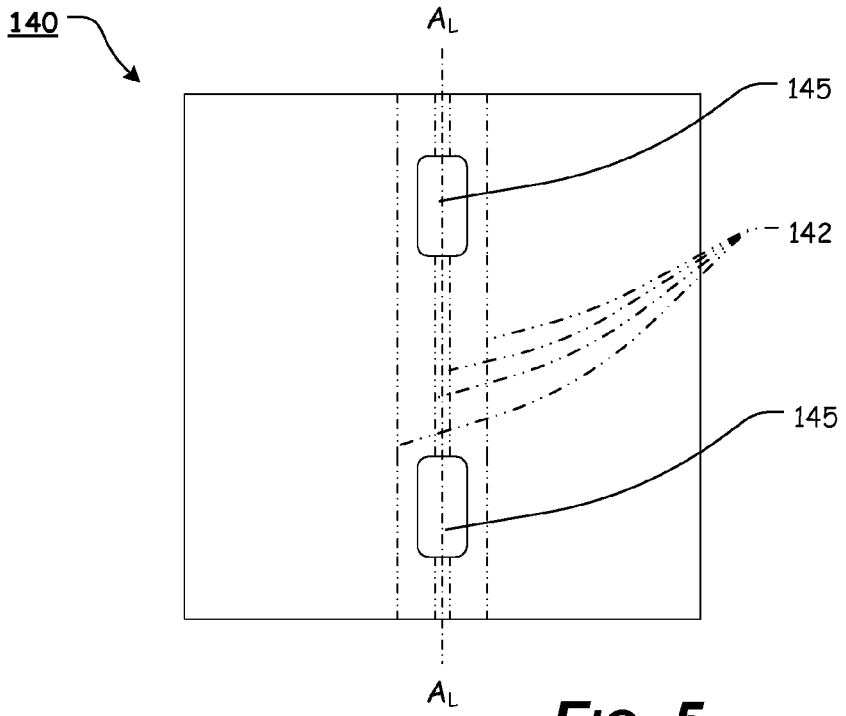
FIG. 5 illustrates a top view of an exemplary embodiment of an insert element, according to the presently disclosed systems, methods, and/or apparatuses.
Figure 6:
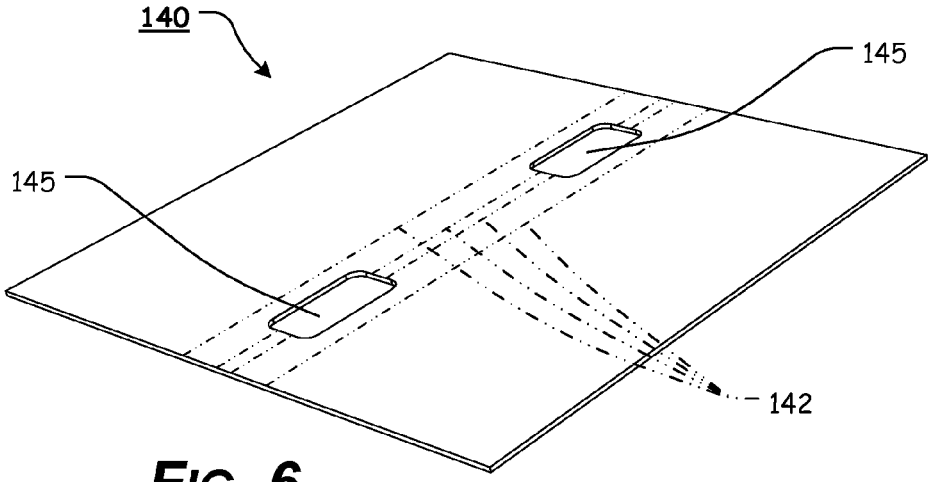
FIG. 6 illustrates a top, side perspective view of an exemplary embodiment of an insert element, according to the presently disclosed systems, methods, and/or apparatuses.

As illustrated most clearly in FIGS. 5-6, the insert element 140 is initially presented as a substantially planar, flat portion of material. By initially being presented in a planar, flat form, numerous insert element 140 may easily be transported and/or stored.

Insert element apertures 145 are formed through portions of the insert element 140. In certain exemplary embodiments, each insert element aperture 145 is formed such that, when folded along appropriate pallet insert fold lines 142, as illustrated most clearly in FIGS. 9-10, the insert element apertures 145 correspond to rail notches 155 formed in the rail member 150 and form insert element notches 147.

The insert element apertures 145 are formed such that, when the pallet assembly 100 is assembled, the entry notches 137 are aligned with the insert element notches 147 to form a substantially continuous entry notch 137 along the width of the pallet assembly 100, substantially perpendicular to the longitudinal axis AL of the panel element 105.

In various exemplary, nonlimiting embodiments, the pallet element 105 and/or the insert element 140 is/are formed of a corrugated fiberboard. Alternate materials of construction of the pallet element 105 and/or the insert element 140 may include one or more of the following: cardboard, card stock, paperboard, paper, pasteboard, container board, box board, chipboard, binders board, other paper-based materials, plastic, corrugated plastic, and/or various combinations of the foregoing.

In certain exemplary embodiments, the pallet element 105 and/or the insert element 140 is/are formed of a single-face laminate or has a coating applied to at least an exterior surface. In these exemplary embodiments, the laminate or other coating provides an optionally printable surface and/or a surface that is waterproof, water-impervious, or has a reduced ink absorbency. Having such a laminate or coating can also make the pallet element 105 and/or other portions of the pallet assembly 100 usable in settings that require pallets that have an exterior surface (or at least an exterior top deck panel portion) that is water impervious or that can be wiped or cleaned prior or after use.

It should be appreciated that the pallet element 105 and the insert element 140 may be formed of the same material. Alternatively, suitable materials can be used and the pallet element 105 may be formed of a material that is different from the material used to form the insert element 140.

Thus, it should be understood that the material or materials used to form the various components of the pallet assembly 100 is a design choice based on the desired appearance and functionality of the pallet assembly 100.

Figure 7:
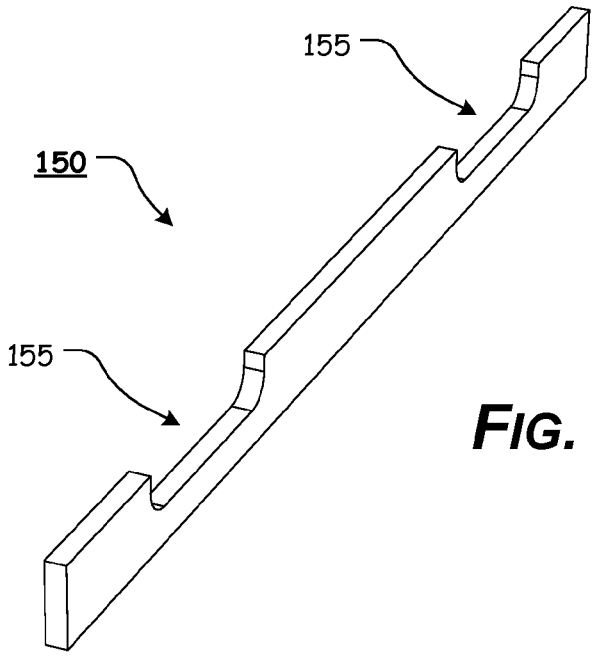
FIG. 7 illustrates a perspective view of an exemplary embodiment of a rail member, according to the presently disclosed systems, methods, and/or apparatuses.
Figure 8:
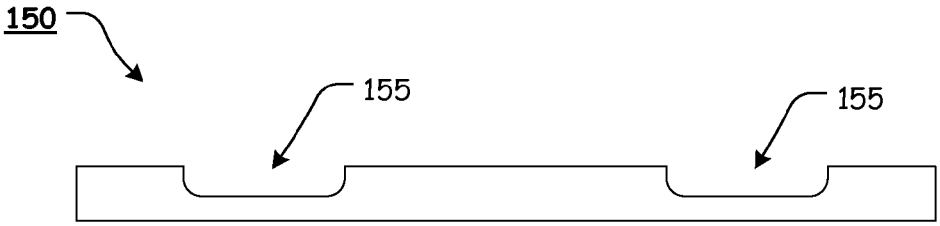
FIG. 8 illustrates a side view of an exemplary embodiment of a rail member, according to the presently disclosed systems, methods, and/or apparatuses.
Figure 9:
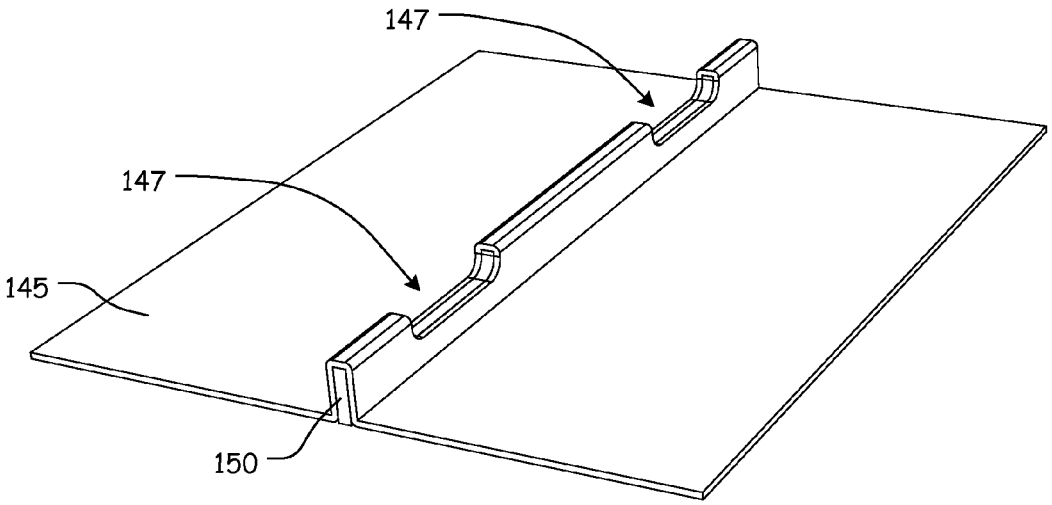
FIG. 9 illustrates a perspective view of an exemplary embodiment of an insert element, according to the presently disclosed systems, methods, and/or apparatuses.
Figure 10:
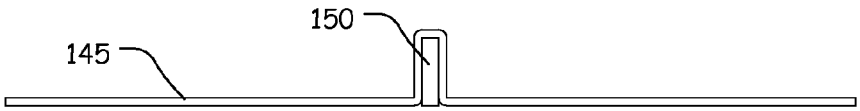
FIG. 10 illustrates an end view of an exemplary embodiment of an insert element, according to the presently disclosed systems, methods, and/or apparatuses.

FIGS. 7-8, show an exemplary embodiment of a rail member 150. As illustrated, the rail member 150 comprises an elongate portion of material having two rail notches 155 formed at spaced apart locations along the rail member 150.

In various exemplary embodiments, rail members 150 are substantially rigid and are formed of a softwood (wood from gymnosperm trees such as conifers) or a hardwood (wood from angiosperm trees). Alternate materials of construction of the various components of the rail members 150 may include one or more of the following: wood, steel, stainless steel aluminum, titanium, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the rail members 150 is a design choice based on the desired appearance and functionality of the rail members 150.

It should be appreciated that the rail members 150 may be used as panel rail members or as an insert element rail member. Thus, the features and elements of the rail members 150 used as panel rail members are the same as those of the rail members 150 used as insert element rail members.

FIGS. 9-21 illustrate the basic assembly of the pallet assembly 100. As illustrated most clearly in FIGS. 9-10, a rail member 150 is aligned proximate the center of the insert element 140, along the longitudinal axis AL of the insert element 140. In this manner, the pallet insert apertures 145 are aligned with the rail notches 155 of the rail member 150. Once the rail member 150 is appropriately aligned, the insert element 140 is folded, along fold lines 142, at least partially around an aligned rail member 150. This results in the rail member 150 being substantially surrounded on a top and two sides by portions of the insert element 140. Thus, a substantially "T" shaped insert element 140 is formed, with the main body portion of the insert element 140 maintaining a substantially planar arrangement.

Because of the alignment of the pallet insert apertures 145 and the rail notches 155, once the insert element 140 is folded at least partially around the aligned rail member 150, the alignment of the pallet insert apertures 145 and the rail notches 155 form insert element notches 147.

In various exemplary embodiments, adjacent surfaces of the rail member 150 and the insert element 140 may optionally be bonded together, such as, by adhesives. Alternatively, portions of the insert element 140 may optionally be attached, coupled, fastened, or secured to the rail member 150, mechanically (i.e., via nails, screws, rivets, pins, or other fasteners) or as otherwise known in the art.

Figure 11:
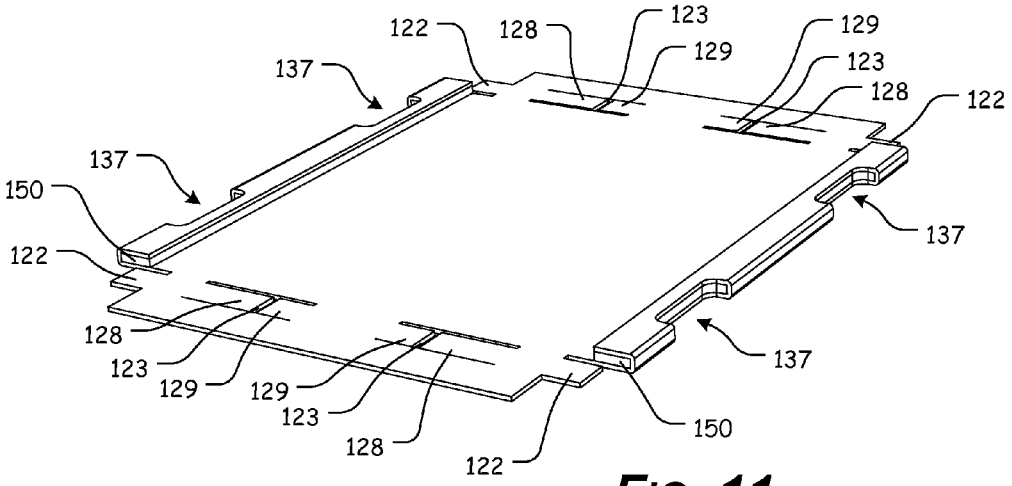
FIG. 11 illustrates a first perspective view of an exemplary embodiment of a partially assembled pallet, wherein a rail member is at least partially folded within each side panel of the pallet element, according to the presently disclosed systems, methods, and/or apparatuses.
Figure 12:
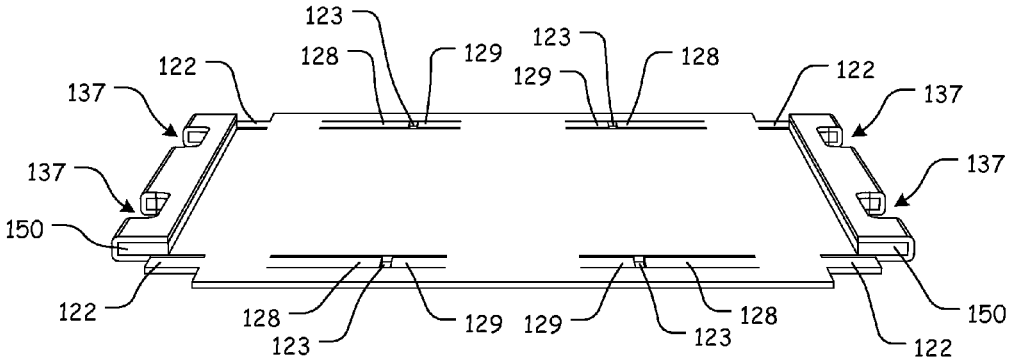
FIG. 12 illustrates a second perspective view of an exemplary embodiment of a partially assembled pallet, wherein a rail member is at least partially folded within each side panel of the pallet element, according to the presently disclosed systems, methods, and/or apparatuses.
Figure 13:
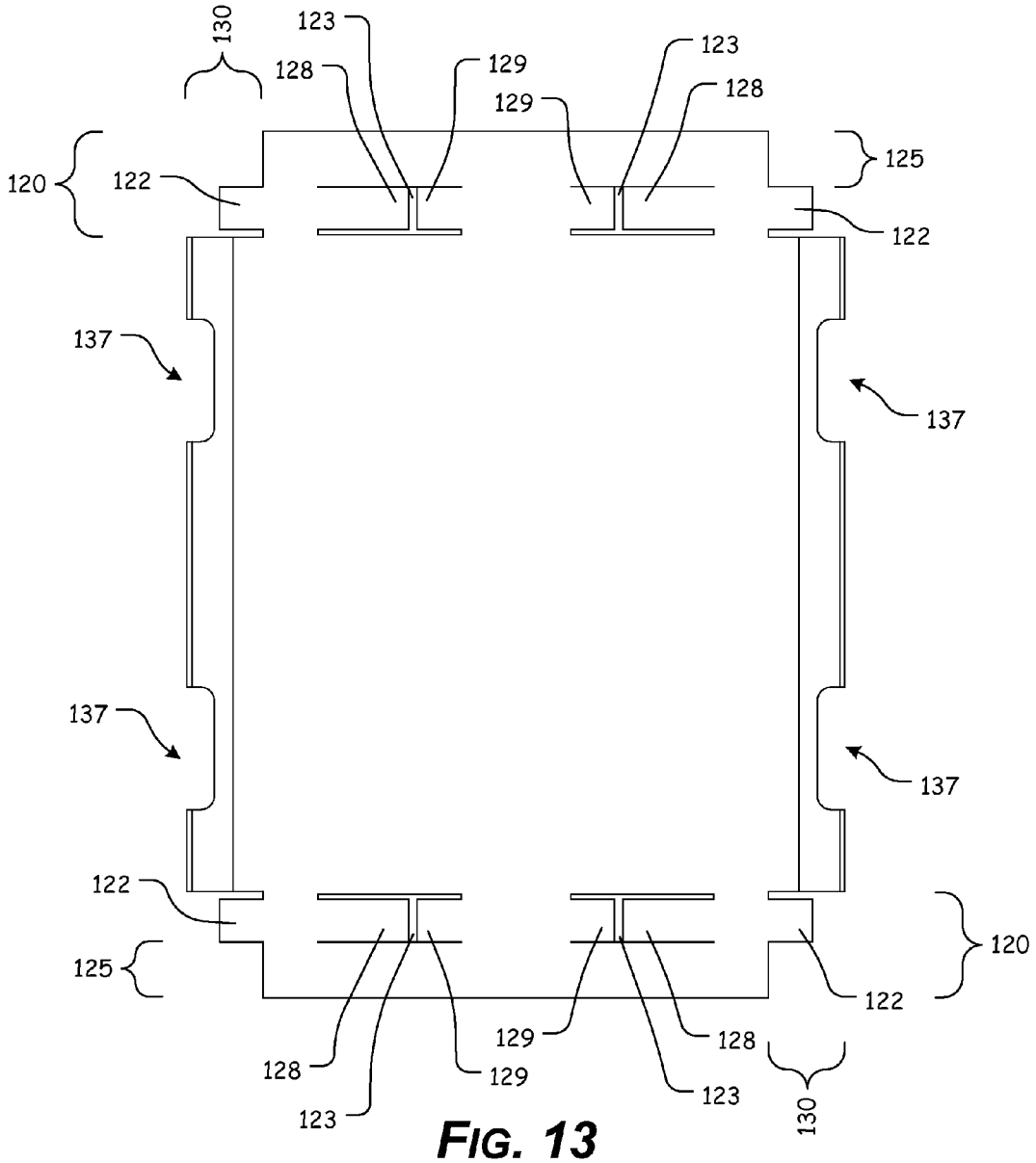
FIG. 13 illustrates a top view of an exemplary embodiment of a partially assembled pallet, wherein a rail member is at least partially folded within each side panel of the pallet element, according to the presently disclosed systems, methods, and/or apparatuses.

As illustrated most clearly in FIGS. 11-13, a rail member 150 is aligned proximate an edge portion of each side panel 130, substantially parallel to the longitudinal axis AL of the pallet element 105. Each rail member 150 is aligned such that the entry notch apertures 135 are aligned with the rail notches 155 of the rail member 150. Once the rail member 150 is appropriately aligned, each side panel 130 is folded, along fold lines 102, at least partially around the aligned rail member 150. This results in the rail member 150 being substantially surrounded on a top and two sides by portions of the side panel 130.

Because of the alignment of the entry notch apertures 135 and the rail notches 155, once the side panels 130 are folded at least partially around the aligned rail member 150, the alignment of the entry notch apertures 135 and the rail notches 155 form entry notches 137.

In various exemplary embodiments, adjacent surfaces of the rail member 150 and the side panels 130 may optionally be bonded together, such as, by adhesives. Alternatively, portions of the side panels 130 may optionally be attached, coupled, fastened, or secured to the rail member 150 mechanically (i.e., via nails, screws, rivets, pins, or other fasteners) or as otherwise known in the art.

Figure 14:
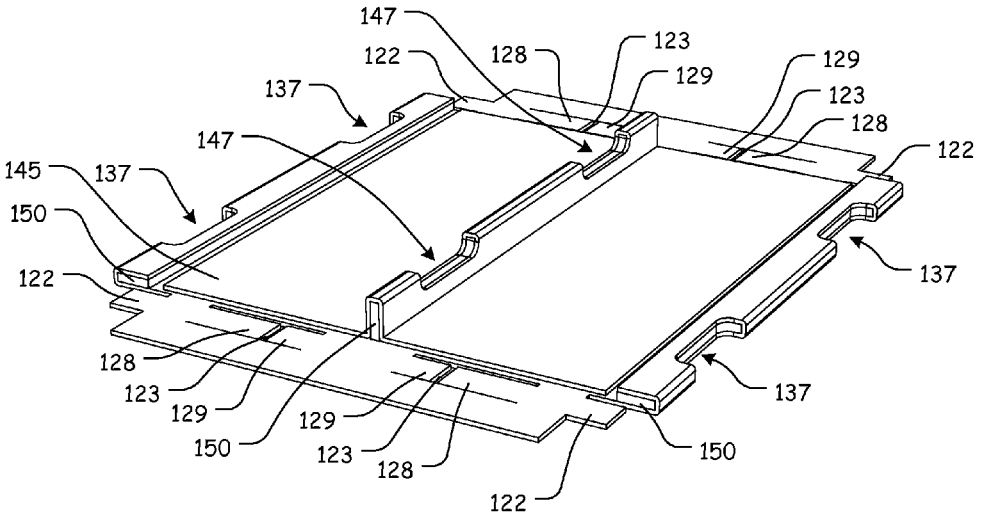
FIG. 14 illustrates a perspective view of an exemplary embodiment of a partially assembled pallet, wherein a rail member is at least partially folded within each side panel of the pallet element, and wherein the insert element is positioned below at least a portion of the top deck panel portion.
Figure 15:
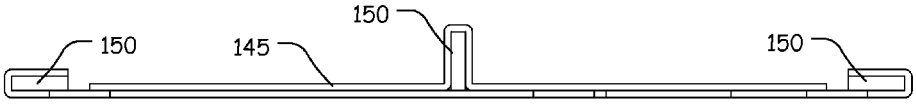
FIG. 15 illustrates an end view of an exemplary embodiment of a partially assembled pallet, wherein a rail member is at least partially folded within each side panel of the pallet element, and wherein the insert element is positioned below at least a portion of the top deck panel portion, according to the presently disclosed systems, methods, and/or apparatuses.

Next, as illustrated most clearly in FIGS. 14-15, a top (substantially planar) surface of the insert element 140 is positioned against a bottom surface of the panel element 105, below at least a portion of the top deck panel portion 110.

In various exemplary embodiments, adjacent surfaces of the insert element 140 and the panel element 105 may optionally be bonded together, such as, by adhesives. Alternatively, portions of the panel element 105 may optionally be attached, coupled, fastened, or secured to the insert element 140 and/or the rail member 150 mechanically (i.e., via nails, screws, rivets, pins, or other fasteners) or as otherwise known in the art.

The insert element 140 helps to reinforce and/or provide support to the top deck panel portion 110 and the pallet assembly 100.

Figure 16:
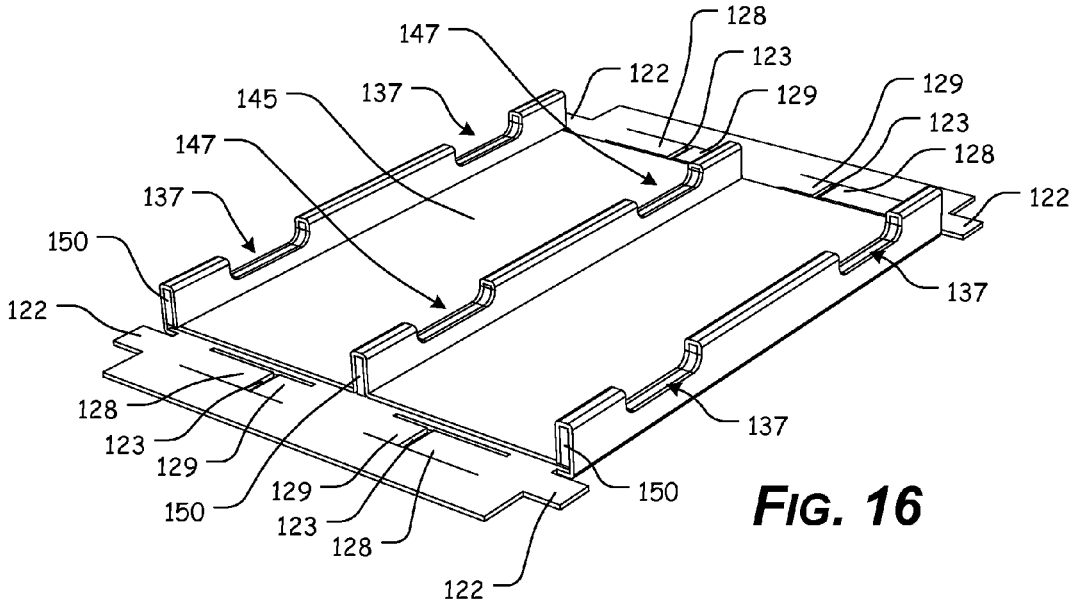
FIG. 16 illustrates a perspective view of an exemplary embodiment of a partially assembled pallet, wherein a rail member is at least partially folded within each side panel of the pallet element to form a pallet side wall, and wherein the insert element is positioned below at least a portion of the top deck panel portion, between the pallet side walls, and wherein at least a portion of the insert element is positioned below at least a portion of each rail member at least partially folded within each side panel, according to the presently disclosed systems, methods, and/or apparatuses.
Figure 17:
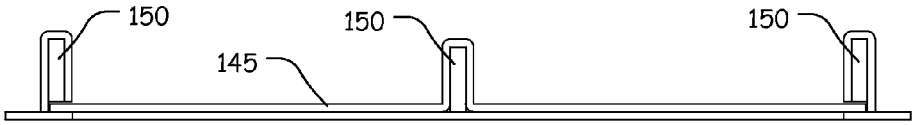
FIG. 17 illustrates an end view of an exemplary embodiment of a partially assembled pallet, wherein a rail member is at least partially folded within each side panel of the pallet element to form a pallet side wall, and wherein the insert element is positioned below at least a portion of the top deck panel portion, between the pallet side walls, and wherein at least a portion of the insert element is positioned below at least a portion of each rail member at least partially folded within each side panel, according to the presently disclosed systems, methods, and/or apparatuses.
Figure 18:
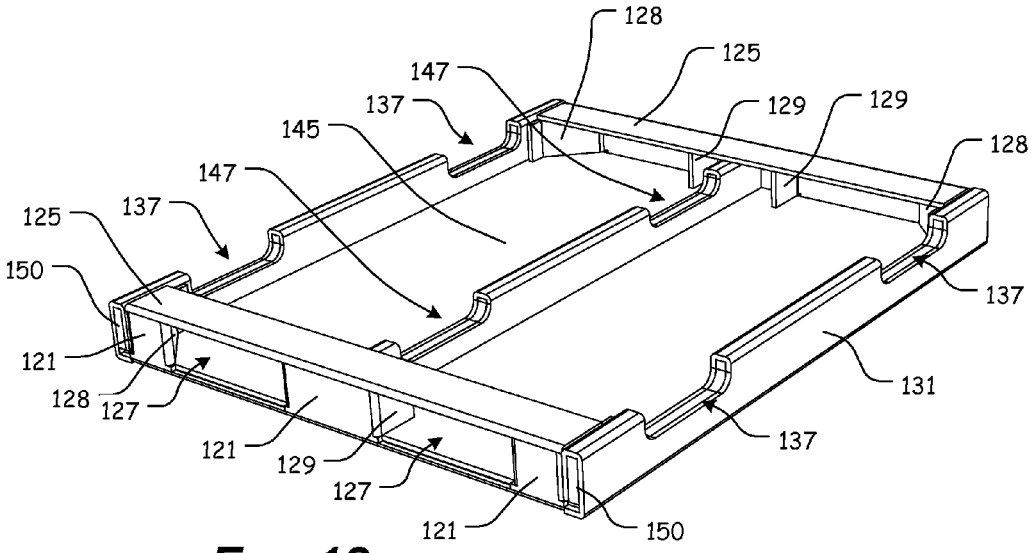
FIG. 18 illustrates a perspective view of an exemplary embodiment of an assembled pallet, wherein a rail member is at least partially folded within each side panel of the pallet element to form a pallet side wall, and wherein the insert element is positioned below at least a portion of the top deck panel portion, and wherein each end panel is at least partially folded to form a pallet end wall, according to the presently disclosed systems, methods, and/or apparatuses.
Figure 19:
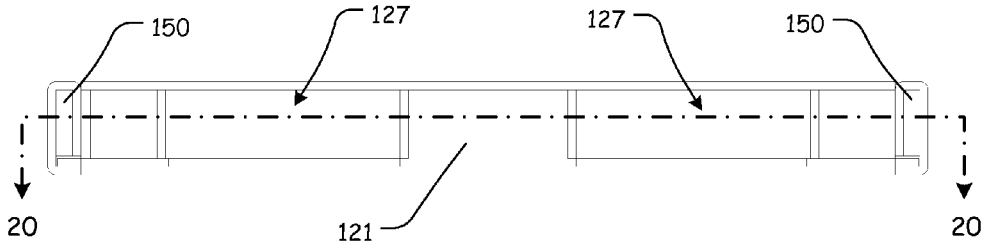
FIG. 19 illustrates an end view of an exemplary embodiment of an assembled pallet, wherein a rail member is at least partially folded within each side panel of the pallet element to form a pallet side wall, and wherein the insert element is positioned below at least a portion of the top deck panel portion, and wherein each end panel is at least partially folded to form a pallet end wall, according to the presently disclosed systems, methods, and/or apparatuses.
Figure 20:
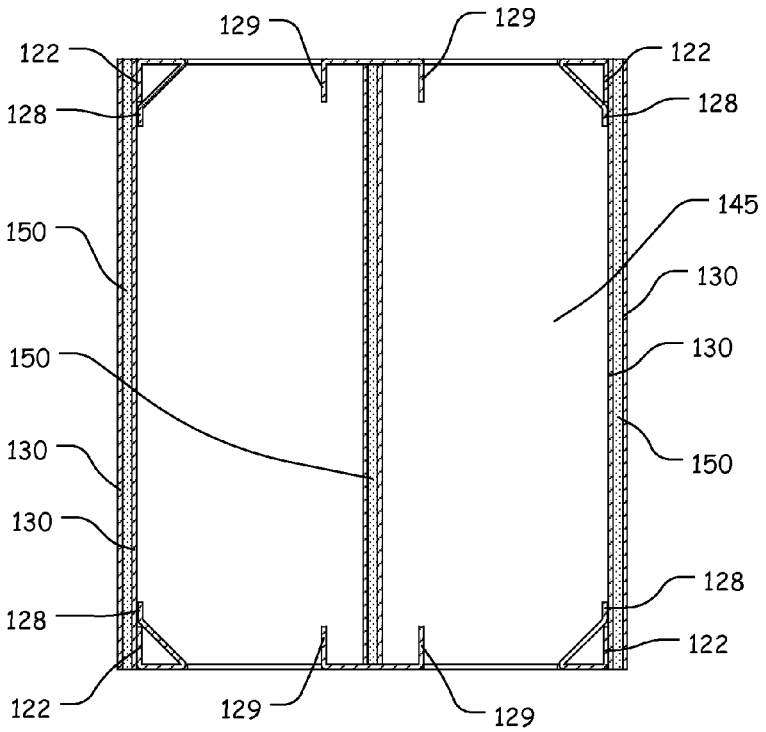
FIG. 20 illustrates a top, cross-sectional view taken along line 20-20 of the assembled pallet of FIG. 19, according to the presently disclosed systems, methods, and/or apparatuses.
Figure 21:
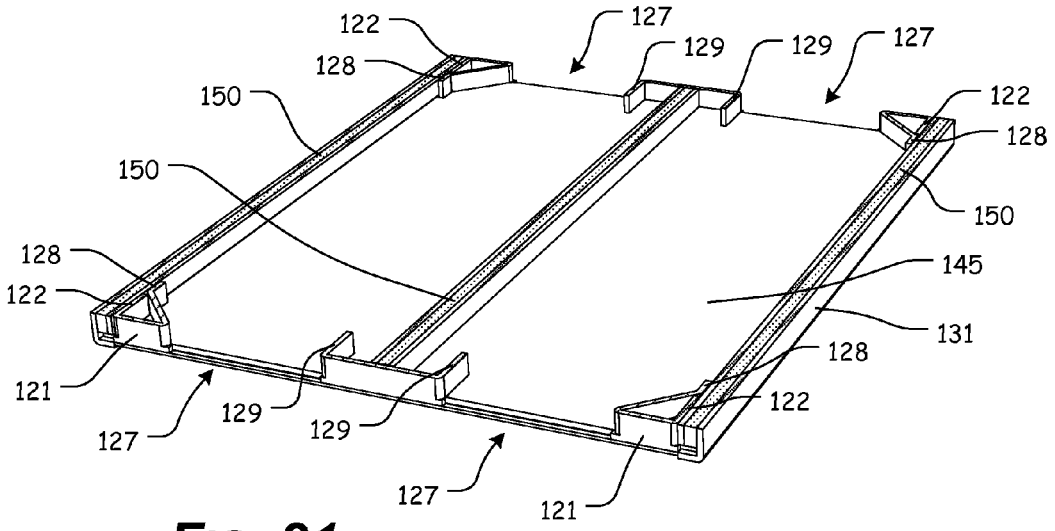
FIG. 21 illustrates a perspective, cross-sectional view taken along line 20-20 of the assembled pallet of FIG. 19, according to the presently disclosed systems, methods, and/or apparatuses.

Then, as illustrated most clearly in FIGS. 16-17, each side panel 130 is further folded, along fold lines 102, such that an outer portion of the side panel 130 is substantially perpendicular to a planar surface of the top deck panel portion 110, thus forming pallet side walls 131.

When the side panels 130 are folded into an appropriate position, opposing edge portions of the insert element 140 are positioned between the pallet side walls 131. Additionally, at least a portion of opposing edge portions of the insert element 140 are positioned below at least a portion of each rail member 150 at least partially folded within each side panel 130.

When the side panels 130 are folded into an appropriate position, the entry notches 137 aligned with the insert element notches 147 to form a substantially continuous entry notch along the width of the pallet assembly 100, substantially perpendicular to the longitudinal axis AL of the panel element 105. In this manner, the forks of a forklift or pallet jack can be inserted through the aligned entry notches 137 and insert element notches 147 to allow the pallet assembly 100 to be lifted off the ground and moved.

Subsequently, as illustrated most clearly in FIGS. 18-21, each end panel 120 is folded, along fold lines 102, such that an outer portion of the end panel 120 is substantially perpendicular to the planar surface of the top deck panel portion 110, thus forming panel end walls 121.

As the end panels 120 are folded into an appropriate position, the end panel side flaps 122 are folded, along panel element fold lines 102, so as to lay against the interior side panel 130. The end panel bottom flaps 125 of the end panels 120 are folded, along panel element fold lines 102, so as to lay substantially parallel to the planar surface of the top deck panel portion 110.

When the end panel side flaps 122 and the end panel bottom flaps 125 are appropriately positioned, the first entry opening flaps 128 and the second entry opening flaps 129 are folded, along panel element fold lines 102, to form entry openings 127 in the pallet end walls 121. The first entry opening flaps 128 are folded such that a portion of the first entry opening flaps 128 lays against the interior side panel 130. The second entry opening flaps 129 are folded such that the second entry opening flaps 129 lay substantially parallel to the longitudinal axis AL of the pallet element 105.

When the first entry opening flaps 128 and the second entry opening flaps 129 are folded to form entry openings 127, the entry openings 127 of the opposing end panels 120 are aligned to form a substantially continuous entry opening along the length of the pallet assembly 100, substantially parallel to the longitudinal axis AL of the panel element 105. In this manner, the forks of a forklift or pallet jack can be inserted through the aligned entry openings 127 to allow the pallet assembly 100 to be lifted off the ground and moved.

In various exemplary embodiments, adjacent surfaces of the end panels 120, the side panels 130, the insert element 140, and/or the panel element 105 may optionally be bonded together, such as, by adhesives. Alternatively, portions of the end panels 120, the side panels 130, the insert element 140, and/or the panel element 105 may optionally be attached, coupled, fastened, secured, or bonded together, mechanically (i.e., vi, upon which a nails, screws, rivets, pins, or other fasteners) or as otherwise known in the art.

By folding and/or attaching, coupling, fastening, securing, or bonding certain of the elements of the panel element 105, the end panels 120, the side panels 130, and/or the insert element 140, additional strength and rigidity can be provided to the pallet assembly 100.

Thus, when assembled, the end panels 120 and the side panels 130 form four peripheral sides, or edges, defining a perimeter of the pallet assembly 100. Generally, the end panels 120 and the side panels 130 are disposed at a substantially right angle to one another, thereby providing the pallet assembly 100 with a generally square or rectangular shape.

The top deck panel portion 110 forms a substantially planar, upper deck surface, upon which items may be placed or stacked.

In certain exemplary, nonlimiting embodiments, the pallet assembly 100 may be constructed having an International Organization for Standardization (ISO) sanctioned pallet dimension (i.e., 40.00"×48.00", 39.37"×47.24", 45.9"×45.9", 42.00"×42.00", 43.30"×43.30", or 31.50"×47.24"), a Grocery Manufacturers' Association (GMA) pallet dimension (i.e., 40"×48", 42"×42", 48"×48", 48"×40", 48"×42", 40"×40", 48"×45", 44"×44", 36"×36", 48"×36", 35"×45.5", or 48"×20"), a European pallet dimension (i.e., 31.50"×47.24", 47.24"×39.37", 39.37"×47.24", 31.50"×23.62", 23.62"×15.75", or 15.75"×11.81"), an Australian pallet dimension (i.e., 45.87"×45.87"), or any desired size or shape. It should also be understood that the overall size and shape of the pallet assembly 100, and the various portions thereof, is a design choice based upon the desired functionality and/or appearance of the pallet assembly 100.

Figure 22:
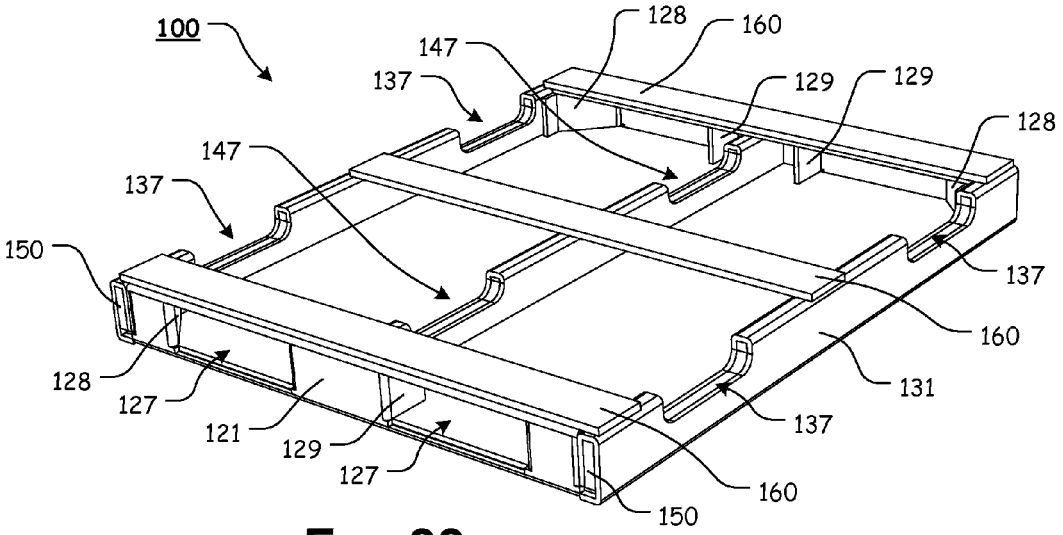
FIG. 22 illustrates a perspective view of an exemplary embodiment of an assembled pallet, wherein the assembled pallet includes optional bottom slats, according to the presently disclosed systems, methods, and/or apparatuses.
Figure 23:
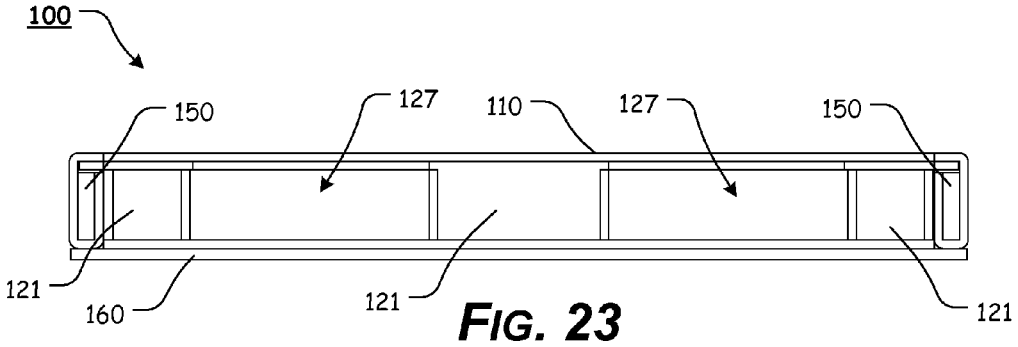
FIG. 23 illustrates an end view of an exemplary embodiment of an assembled pallet, wherein the assembled pallet includes optional bottom slats, according to the presently disclosed systems, methods, and/or apparatuses.
Figure 24:
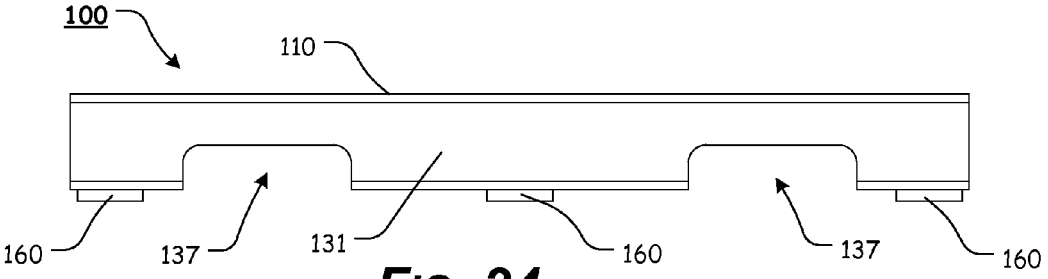
FIG. 24 illustrates a side view of an exemplary embodiment of an assembled pallet, wherein the assembled pallet includes optional bottom slats, according to the presently disclosed systems, methods, and/or apparatuses.

FIGS. 22-24 illustrate certain exemplary, nonlimiting embodiments, wherein bottom slats 160 are attached or coupled to bottom portions of the pallet assembly 100. If included, the bottom slats 160 comprise substantially rigid, elongate portions of wood, composite, or other material. The bottom slats 160 provide additional rigidity to the pallet assembly 100 and may also provide a surface having a desired degree of friction relative to a floor or other support surface. Thus, the bottom surface of the bottom slats 160 may be chosen so as to allow a pallet assembly 100 to resist movement relative to a floor or other surface or more easily slide across a floor or other surface.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Furthermore, where a range of values or dimensions is provided, it is understood that every intervening value or dimension, between the upper and lower limit of that range and any other stated or intervening value or dimension in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A pallet assembly, comprising:

(a) a pallet element extending from a top deck panel portion to opposing end panels and side panels, wherein at least a portion of each side panel is at least partially folded to overlay a top and two sides of a panel rail member to form opposing pallet sidewalls, and wherein each end panel is at least partially folded to form opposing pallet end walls;

(b) two or more entry opening cutouts formed through portions of the end panels, wherein each entry opening cutout defines at least a first entry opening flap, and wherein the first entry opening flaps are folded to form entry openings through the end panels;

(c) two or more notch apertures formed through portions of the side panels, wherein each entry notch aperture is aligned with a rail notch formed in each of the panel rail members to form an entry notch where each entry notch aperture is aligned with a rail notch of the panel rail members;

(d) an insert element, wherein at least a portion of the insert element is at least partially folded to overlay a top and two sides of an insert element rail member, wherein the insert element is positioned below at least a portion of the top deck panel portion, wherein the insert element is positioned between the pallet side walls, and wherein at least a portion of the insert element is positioned below at least a portion of each panel rail member; and (e) two or more insert element apertures formed through portions of the insert element, wherein each insert element aperture is aligned with a rail notch formed in the insert element rail member to form an insert element notch where each insert element aperture is aligned with a rail notch in the insert element rail member.

2. The pallet assembly of claim 1, wherein the top deck panel portion is substantially planar.

3. The pallet assembly of claim 1, wherein the insert element rail member is positioned proximate a central portion of the insert element.

4. The pallet assembly of claim 1, wherein the end panels extend substantially perpendicular to a longitudinal axis of the panel element, and wherein the side panels extend substantially parallel to the longitudinal axis of the panel element.

5. The pallet assembly of claim 1, wherein end panel side flaps extend from the end panels.

6. The pallet assembly of claim 1, wherein two or more entry opening cutouts are formed through portions of the end panels, and wherein each entry opening cutout defines a first entry opening flap and a second entry opening flap, and wherein the first entry opening flaps and the second entry opening flaps are folded to form entry openings.

7. The pallet assembly of claim 6, wherein each entry opening cutout is formed of a substantially "H" shaped cut or slot.

8. The pallet assembly of claim 1, wherein two or more entry openings are aligned with one another.

9. The pallet assembly of claim 1, wherein two or more entry notches formed in opposing side panels are aligned with one another.

10. The pallet assembly of claim 1, wherein the pallet element is formed of corrugated fiberboard, cardboard, card stock, paperboard, paper, pasteboard, container board, box board, chipboard, binders board, a paper-based material, plastic, or corrugated plastic.

11. The pallet assembly of claim 1, wherein the pallet element is formed of a single-face laminate.

12. The pallet assembly of claim 1, wherein the pallet element has a waterproof or water-impervious coating applied to at least a portion of an exterior surface of the pallet element.

13. The pallet assembly of claim 1, wherein the panel rail members and the insert element rail member each comprise an elongate portion of material having two rail notches formed at spaced apart locations along the panel rail member and the insert element rail member.

14. The pallet assembly of claim 1, wherein bottom slats are attached or coupled to bottom portions of the pallet assembly.

15. A pallet assembly, comprising:

(a) a pallet element extending from a top deck panel portion to opposing end panels and side panels, wherein at least a portion of each side panel is at least partially folded to overlay a top and two sides of a panel rail member to form opposing pallet sidewalls, and wherein each end panel is at least partially folded to form opposing pallet end walls;

(b) two or more notch apertures formed through portions of the side panels, wherein each entry notch aperture is aligned with a rail notch formed in each of the panel rail members to form an entry notch where each entry notch aperture is aligned with a rail notch of the panel rail members;

(c) an insert element, wherein at least a portion of the insert element is at least partially folded to overlay a top and two sides of an insert element rail member, wherein the insert element is positioned below at least a portion of the top deck panel portion, wherein the insert element is positioned between the pallet side walls, and wherein at least a portion of the insert element is positioned below at least a portion of each panel rail member; and (d) two or more insert element apertures formed through portions of the insert element, wherein each insert element aperture is aligned with a rail notch formed in the insert element rail member to form an insert element notch where each insert element aperture is aligned with a rail notch in the insert element rail member.

16. The pallet assembly of claim 1, further comprising two or more entry opening cutouts formed through portions of the end panels, wherein each entry opening cutout defines an entry opening through the end panels.

17. A method for assembling a pallet assembly, wherein the pallet assembly comprises:

(a) a pallet element extending from a top deck panel portion to opposing end panels and side panels, wherein two or more entry opening cutouts are formed through portions of the end panels, wherein each entry opening cutout defines at least a first entry opening flap, wherein two or more notch apertures are formed through portions of the side panels;

(b) an insert element, wherein two or more insert element apertures are formed through portions of the insert element;

(c) at least two panel rail members, wherein each of the panel rail members comprises an elongate portion of material having two rail notches formed at spaced apart locations along the panel rail member;

(d) at least one insert element rail member, wherein the insert element rail member comprises an elongate portion of material having two rail notches formed at spaced apart locations along the insert element rail member;

the method comprising:

(a) folding at least a portion of each side panel to form opposing pallet side walls, wherein at least a portion of each side panel is at least partially folded to overlay a top and two sides of a panel rail member, wherein each entry notch aperture is aligned with a rail notch formed in each of the panel rail members to form an entry notch where each entry notch aperture is aligned with a rail notch of the panel rail members;

(b) positioning the insert element below at least a portion of the top deck panel portion between the pallet side walls;

(c) folding each pallet side wall such that at least a portion of the insert element is positioned below at least a portion of each panel rail member at least partially folded within each side panel;

(d) folding at least a portion of each end panel to form opposing pallet end walls and end panel bottom flaps; and (e) folding each of the first entry opening flaps to form entry openings through the end panels.

18. The method of claim 17, further comprising aligning each insert element aperture with a rail notch formed in the insert element rail member to form an insert element notch where each insert element aperture is aligned with a rail notch in the insert element rail member.

19. The method of claim 17, further comprising attaching or coupling bottom slats to bottom portions of the pallet assembly.

20. The method of claim 17, further comprising attaching, coupling, fastening, securing, or bonding at least certain portions of the pallet element, the end panels, the side panels, and/or the insert element to one another.

* * * * *